US010281862B2

(12) United States Patent
Aoki et al.

(10) Patent No.: US 10,281,862 B2
(45) Date of Patent: May 7, 2019

(54) IMAGE FORMING APPARATUS INCLUDING AN IMAGE DENSITY DETECTOR OF HALFTONE IMAGES

(71) Applicants: Shinji Aoki, Ishikawa (JP); Kei Hasegawa, Kanagawa (JP); Shintaro Yamada, Tokyo (JP); Rie Mitani, Hyogo (JP); Yohsuke Terada, Kanagawa (JP)

(72) Inventors: Shinji Aoki, Ishikawa (JP); Kei Hasegawa, Kanagawa (JP); Shintaro Yamada, Tokyo (JP); Rie Mitani, Hyogo (JP); Yohsuke Terada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/915,098

(22) Filed: Mar. 8, 2018

(65) Prior Publication Data

US 2018/0267452 A1 Sep. 20, 2018

(30) Foreign Application Priority Data

Mar. 17, 2017 (JP) ..... 2017-052435

(51) Int. Cl.
*G03G 15/00* (2006.01)

(52) U.S. Cl.
CPC ..... *G03G 15/5062* (2013.01); *G03G 15/5058* (2013.01); *G03G 2215/00037* (2013.01);
(Continued)

(58) Field of Classification Search
CPC ..... G03G 15/1645; G03G 15/1675; G03G 15/5062; G03G 15/5058;
(Continued)

(56) References Cited

U.S. PATENT DOCUMENTS 5,918,086 A * 6/1999 Nakano ..... G03G 15/1675 399/297
7,672,606 B2 * 3/2010 Imagawa ..... G03G 15/1675 399/49

(Continued)

FOREIGN PATENT DOCUMENTS

JP 2-123385 5/1990
JP 2006017911 A * 1/2006
JP 2009-139912 6/2009

OTHER PUBLICATIONS

U.S. Appl. No. 15/081,509, filed Mar. 25, 2016, Shinji Aoki, et al.

*Primary Examiner* — Robert B Beatty
(74) *Attorney, Agent, or Firm* — Oblon, McClelland, Maier & Neustadt, L.L.P.

(57) ABSTRACT

An image forming apparatus includes a latent image bearer to bear a plurality of halftone images having a same image density and a high-density image located one cycle downstream of the latent image bearer from at least one of the plurality of halftone images, a transferor to apply a predetermined transfer voltage to transfer the plurality of halftone images and the high-density image, a transfer electric field forming target to bear the plurality of halftone images and the high-density image transferred from the latent image bearer, a detector to detect image densities of the plurality of halftone images on the transfer electric field forming target, and a controller to determine a primary transfer voltage applied at a time of image formation, based on image density variations of the plurality of halftone images detected by the detector.

6 Claims, 8 Drawing Sheets

(52) U.S. Cl.
CPC ..... *G03G 2215/00042* (2013.01); *G03G 2215/00059* (2013.01); *G03G 2215/00063* (2013.01)

(58) Field of Classification Search
CPC ..... G03G 2215/00037; G03G 2215/00063; G03G 2215/00042; G03G 2215/00059; G03G 2215/00067
USPC ..... 399/49, 66
See application file for complete search history.

(56) References Cited

U.S. PATENT DOCUMENTS 9,042,755 B2 * 5/2015 Rotberg ..... B41J 29/393 399/49
2002/0041769 A1 * 4/2002 Nakai ..... G03G 15/1605 399/49
2003/0012578 A1 1/2003 Ishii et al.
2003/0128993 A1 7/2003 Mitsuya et al.
2005/0025510 A1 2/2005 Yamada et al.
2005/0163518 A1 7/2005 Onose et al.
2006/0024074 A1 * 2/2006 Maeda ..... G03G 15/1675 399/44
2006/0198645 A1 9/2006 Yamada et al.
2007/0189812 A1 8/2007 Murayama et al.
2008/0145109 A1 6/2008 Murayama et al.
2009/0016792 A1 1/2009 Yamada et al.
2009/0123168 A1 5/2009 Aoki et al.
2010/0028057 A1 2/2010 Yamada et al.
2010/0166443 A1 * 7/2010 Muto ..... G03G 15/5041 399/49
2010/0232820 A1 9/2010 Usami et al.
2010/0284705 A1 11/2010 Aoki et al.
2011/0058831 A1 3/2011 Usami et al.
2011/0200348 A1 8/2011 Aoki
2011/0255892 A1 10/2011 Aoki
2012/0045231 A1 2/2012 Ogino et al.
2012/0045237 A1 2/2012 Aoki et al.
2012/0045259 A1 2/2012 Nakamura et al.
2012/0224873 A1 9/2012 Aoki
2012/0230715 A1 9/2012 Ogino et al.
2012/0237234 A1 9/2012 Sugimoto et al.
2012/0243892 A1 9/2012 Nakamura et al.
2012/0294637 A1 * 11/2012 Tanaka ..... G03G 15/0115 399/49
2013/0121734 A1 5/2013 Aoki
2013/0142531 A1 6/2013 Sugimoto et al.
2013/0148993 A1 6/2013 Aoki et al.
2013/0287417 A1 * 10/2013 Saito ..... G03G 15/1675 399/49
2014/0010560 A1 * 1/2014 Obara ..... G03G 13/22 399/49
2014/0010562 A1 1/2014 Tanaka et al.
2014/0169817 A1 6/2014 Sugimoto et al.
2015/0268028 A1 9/2015 Hirota et al.
2015/0286168 A1 10/2015 Sugimoto et al.
2015/0338792 A1 11/2015 Nakamura et al.
2016/0161889 A1 6/2016 Tanaka et al.
2016/0363907 A1 12/2016 Enomoto et al.
2017/0146931 A1 5/2017 Tanaka et al.

* cited by examiner

IMAGE FORMING APPARATUS INCLUDING AN IMAGE DENSITY DETECTOR OF HALFTONE IMAGES

CROSS-REFERENCE TO RELATED APPLICATION

This patent application is based on and claims priority pursuant to 35 U.S.C. § 119(a) to Japanese Patent Application No. 2017-052435, filed on Mar. 17, 2017, in the Japan Patent Office, the entire disclosure of which is hereby incorporated by reference herein.

BACKGROUND

Technical Field

This disclosure relates to an image forming apparatus.

Related Art

In electrophotographic image forming apparatuses such as printers, copiers, facsimile machines, and the like, there are two transfer methods: a direct transfer method in which a toner image on a latent image bearer is directly transferred onto a transfer medium such as a copy paper; and an intermediate transfer method (also referred to as an indirect transfer method), in which the toner image on the latent image bearer is transferred and superimposed onto an intermediate transfer member such as an intermediate transfer belt and then secondarily transferred onto the transfer medium. In each of these methods, a transferor applies a transfer voltage having the same or opposite polarity to a charging polarity of the toner image to a transfer electric field forming target to form a transfer electric field, thereby transferring the toner image onto the transfer medium or the intermediate transfer member by electrostatic attraction or electrostatic repulsion. The transferor is, for example, a primary transferor and a secondary transferor. The transfer electric field forming target is, for example, a conveyance belt in the direct transfer method, or the intermediate transfer belt in the intermediate transfer method, and the transfer medium.

SUMMARY

According to an embodiment of this disclosure, an improved image forming apparatus includes a latent image bearer to bear a plurality of halftone images having a same image density and a high-density image located one cycle downstream of the latent image bearer from at least one of the plurality of halftone images, a transferor to apply a predetermined transfer voltage to transfer the plurality of halftone images and the high-density image, a transfer electric field forming target to bear the plurality of halftone images and the high-density image transferred from the latent image bearer, a detector to detect image densities of the plurality of halftone images on the transfer electric field forming target, and a controller to determine the primary transfer voltage applied at a time of image formation, based on image density variations of the plurality of halftone images detected by the detector. The high-density image has a larger amount of toner per unit area than the plurality of halftone images.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
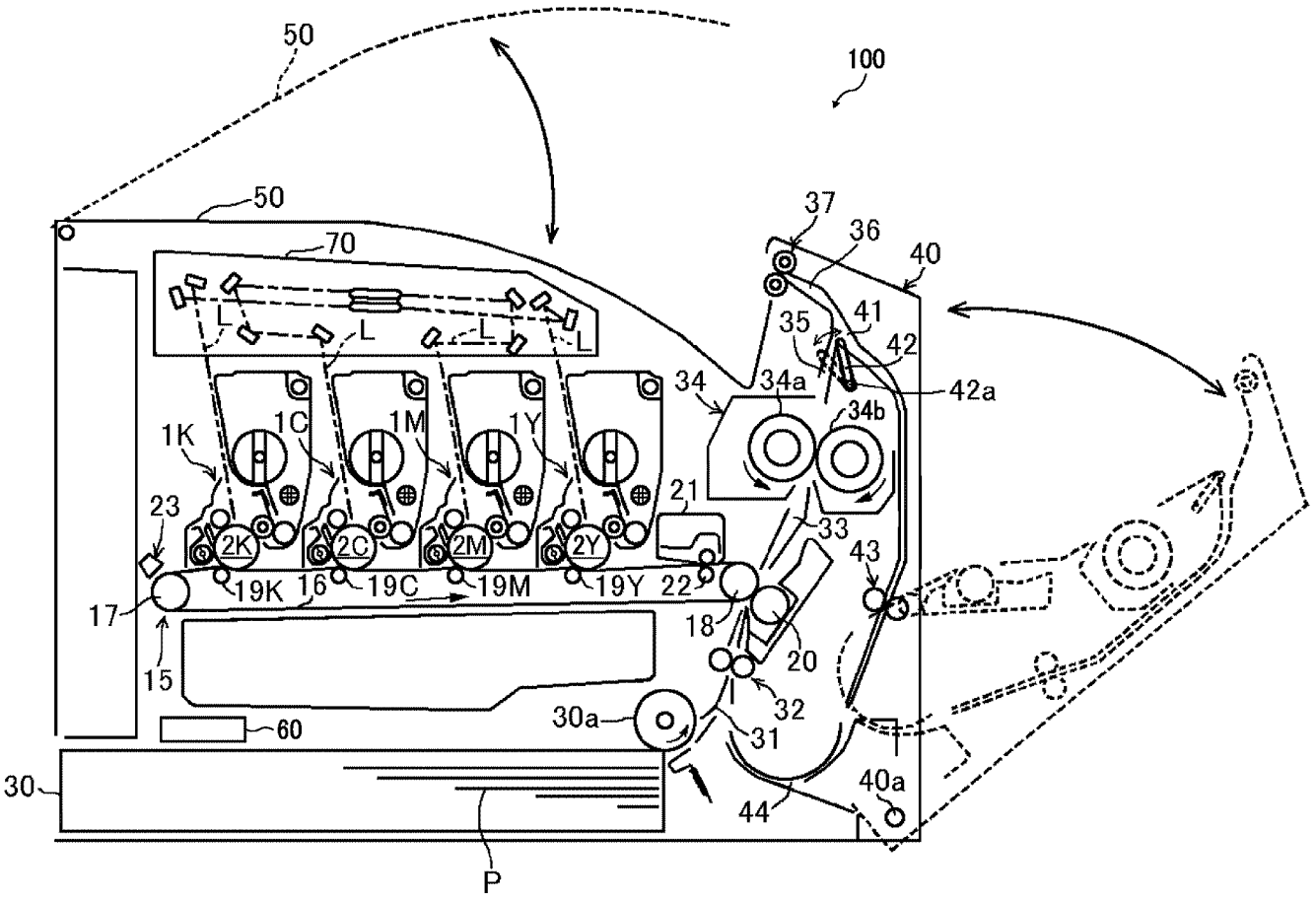
FIG. 1 is a schematic view illustrating a color printer as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Descriptions are given below of one embodiment of an electrophotographic color printer (hereinafter, simply referred to as a printer) as an image forming apparatus according to the present disclosure. First, the basic configuration of a printer 100 is described. FIG. 1 is a schematic configuration view illustrating the printer 100. As illustrated in FIG. 1, the printer 100 includes four image forming units 1Y, 1M, 1C, and 1K to form toner images composed of polyester-based polymerization toners of yellow, magenta, cyan, and black (hereinafter referred to as Y, M, C, and K). The toners consist of particles having an average particle diameter of 6.5 μm.

All the image forming units 1Y, 1M, 1C, and 1K have the same configuration, differing only in the color of toner used as an image forming material. The image forming units 1Y, 1M, 1C, and 1K are replaced once wearing out. As an example illustrated in FIG. 2, the image forming unit 1K for forming a K toner image includes a drum-shaped photoconductor 2K (organic photoconductor having a diameter of 30 mm) as a latent image bearer, a drum cleaner 3K, a charging device 4K, and a developing device 5K. The image forming unit 1K can be attached to and detached from a printer body, so that expendable parts can be replaced at one time. A moving speed of the photoconductor 2K, that is, a process linear velocity of the printer 100 is 140 mm/s.

Figure 2:
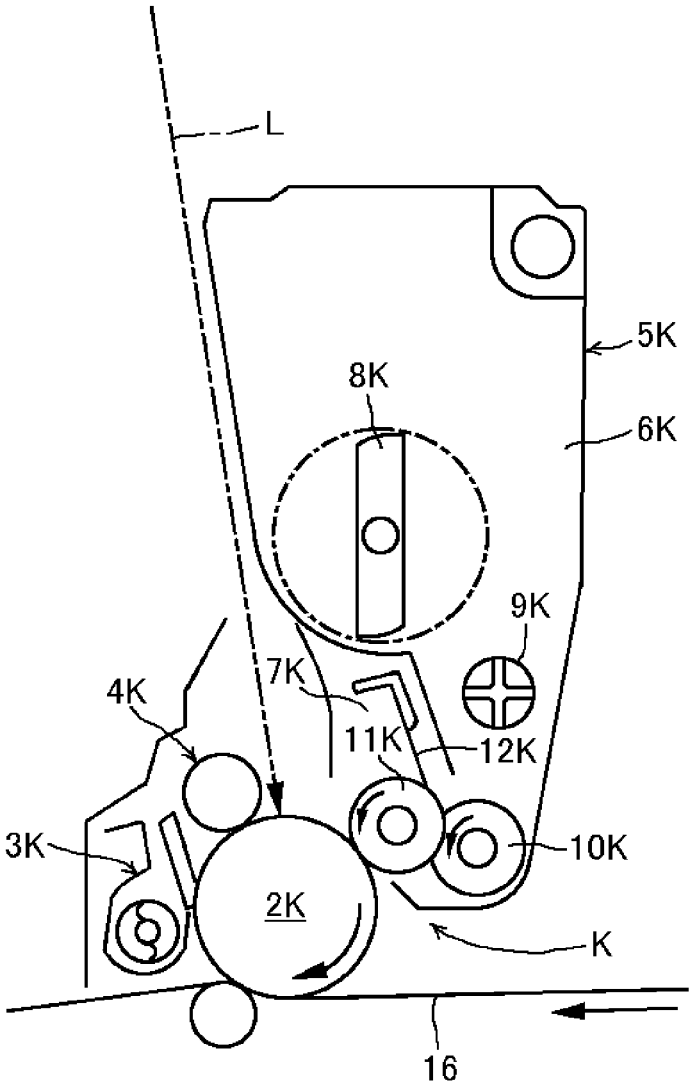
FIG. 2 is an enlarged view illustrating an image forming unit for black in the printer in FIG. 1.

A direct current (DC) voltage of 1.1 to 1.2 kV is applied to the charging device 4K including a roller, and a surface of the photoconductor 2K rotating in the clockwise direction in FIG. 2 is uniformly charged to −0.5 to −0.6 kV. The surface of the uniformly charged photoconductor 2K is exposed and scanned by a laser beam L to bear an electrostatic latent image for K. More specifically, in FIG. 1, an optical writing unit 70 as a latent image writing device disposed above the image forming units 1Y, 1M, 1C, and 1K irradiates and scans the photoconductor 2Y, 2M, 2C, and 2K of the image forming units 1Y, 1M, 1C, and 1K with the laser beam L from a laser diode based on image data. The electric potential of the exposed portion of the photoconductors 2Y, 2M, 2C, and 2K is attenuated, and electrostatic latent images for Y, M, C, and K are formed on the photoconductors 2Y, 2M, 2C, and 2K. For example, the potentials of the electrostatic latent images are attenuated to −30 to −50 V versus −0.5 to −0.6 kV uniformly charged potentials of the photoconductors 2Y, 2M, 2C, and 2K. The optical writing unit 70 irradiates the photoconductors 2Y, 2M, 2C, and 2K via a plurality of optical lenses and mirrors with the laser beam L while polarizing the laser beam L emitted from a light source in the main scanning direction with a rotating polygon mirror. Alternatively, the optical writing unit 70 may employ a light source using a light emitting diode (LED) array including a plurality of LEDs that emits light to form the electrostatic latent images.

In FIG. 2, the developing device 5K includes a longitudinally extended hopper portion 6K for accommodating K toner and a developing portion 7K. The photoconductor 2K, a developing roller 11K, and a regulating blade 12K are disposed in the developing portion 7K of the developing device 5K. The developing roller 11K rotates while abutting against a toner supply roller 10K made of urethane foam. In the present embodiment, the developing roller 11K includes a conductive urethane rubber layer and has a diameter of 16 mm. The conductive urethane rubber layer has a thickness of 4 mm and a rubber hardness of 50° on the Japanese Industrial Standards A (JIS-A) scale. Further, the regulating blade 12K made of stainless steel abuts against a surface of the developing roller 11K at a tip thereof. The regulating blade 12K has a thickness of 0.1 mm and a tip bending angle of 14°. A voltage is applied to the regulating blade 12K. A developing bias is applied to the developing roller 11K rotating in the counterclockwise direction in FIG. 2. The developing bias has the same polarity as the charging polarity of the K toner and an absolute potential value between an absolute potential value of a background portion and an absolute potential value of the electrostatic latent image of the photoconductor 2K. As a result, in a developing region in which the photoconductor 2K and the developing roller 11K face each other, the K toner carried on the surface of the developing roller 11K is selectively transferred to the electrostatic latent image on the photoconductor 2K, thereby developing the electrostatic latent image into the K toner image. Subsequently, the K toner image is intermediately transferred onto an intermediate transfer belt 16 described later. The linear velocity of the developing roller 11K is 200 mm/s, and the developing bias is approximately −0.2 kV.

An agitator 8K, a stirring paddle 9K, and the toner supply roller 10K are disposed in the hopper portion 6K above the developing portion 7K. The K toner in the hopper portion 6K moves toward the toner supply roller 10K under its own weight while being agitated by rotation of the agitator 8K and the stirring paddle 9K. The toner supply roller 10K has a diameter of 13 mm and includes a metal core and a roller portion made of conductive foamed urethane (cell diameter is 100 to 500 μm) coated on the surface of the metal core. The toner supply roller 10K rotates while capturing the K toner in the hopper portion 6K by the roller portion.

The developing roller 11K and the toner supply roller 10K disposed on the right side of the developing roller 11K rotate counterclockwise in FIG. 2. The developing roller 11K and the toner supply roller 10K contact each other to form a supply nip having a nip width of 4 to 5 mm. In the supply nip, the surface of the developing roller 11K moves upward in the vertical direction while a surface of the toner supply roller 10K moves downward in the vertical direction. In this manner, the toner supply roller 10K abuts and rotates against movement of the developing roller 11K to form the supply nip. Hereinafter, a position where the surface of the developing roller 11K enters the supply nip is referred to as a nip entrance. A position where the surface of the developing roller 11K exits from the supply nip is referred to as a nip outlet. The linear velocity of the toner supply roller 10K is 200 mm/s.

As described above, the developing bias is applied to the developing roller 11K by a developing bias power source. The developing bias has the same polarity as the charging polarity of the K toner and the absolute potential value between the absolute potential value of the background portion and the absolute potential value of the electrostatic latent image of the photoconductor 2K. On the other hand, a supply bias having a DC voltage with the same polarity as the charging polarity of the K toner is applied to the toner supply roller 10K. The supply bias is −200 V.

The surface of the developing roller 11K, which has developed the electrostatic latent image on the photoconductor 2K in the developing region, enters the nip entrance of the supply nip as the developing roller 11K rotates. At that time, the surface of the toner supply roller 10K rubs against the surface of the developing roller 11K while moving in the opposite direction to the movement of the developing roller 11K at the nip entrance. At that time, the K toner on the toner supply roller 10K is supplied to the developing roller 11K by a potential difference between the developing bias applied to the developing roller 11K and the supply bias applied to the toner supply roller 10K.

The layer thickness of the K toner supplied from the toner supply roller 10K to the developing roller 11K is regulated on the surface of the developing roller 11K when the K toner passes beneath the regulating blade 12K as the developing roller 11K rotates. Then, the K toner after the layer thickness regulation contributes to the development of the electrostatic latent image on the surface of the photoconductor 2K in the developing region. In the developing region, as illustrated in FIG. 2, the surface of the photoconductor 2K and the surface of the developing roller 11K move in the same direction.

In FIG. 2, the drum cleaner 3K removes transfer residual toner adhering to the surface of the photoconductor 2K after an intermediate transfer process. Any residual charge left on the photoconductor 2K is neutralized after cleaning, and the surface of the photoconductor 2K is initialized and readied for the next image formation. Although the image forming unit 1K for K has been described above, the image forming units 1Y, 1M, and 1C for Y, M, and C can also perform the same image forming process on the surfaces of the photoconductors 2Y, 2M, and 2C, and the toner images are transferred and superimposed onto the intermediate transfer belt 16.

Referring back to FIG. 1, a transfer unit 15 including the endless intermediate transfer belt 16 as a transfer electric field forming target is disposed below the image forming units 1Y, 1M, 1C, and 1K. In addition to the intermediate transfer belt 16, the transfer unit 15 includes a driving roller 17, a driven roller 18, four primary transfer rollers 19Y, 19M, 19C, and 19K, a secondary transfer roller 20, a belt cleaner 21, and a cleaning backup roller 22.

The intermediate transfer belt 16 is endlessly rotated in the same direction by the rotary power of the driving roller 17 disposed inside the loop formed by the intermediate transfer belt 16 and rotating counterclockwise in FIG. 1. The four primary transfer rollers 19Y, 19M, 19C, and 19K as a transferor disposed inside the loop of the intermediate transfer belt 16 sandwich the intermediate transfer belt 16 with the photoconductors 2Y, 2M, 2C, and 2K, thereby forming primary transfer nips for Y, M, C, and K in which a front surfaces of the intermediate transfer belt 16 contacts the photoconductors 2Y, 2M, 2C, and 2K. The primary transfer rollers 19Y, 19M, 19C, and 19K apply primary transfer voltages to form transfer electric fields between the electrostatic latent images on the photoconductors 2Y, 2M, 2C, and 2K and the primary transfer rollers 19Y, 19M, 19C, and 19K, respectively. The method for adjusting the applied primary transfer voltage is described later.

As the Y toner image formed on the surface of the photoconductor 2Y of the image forming unit 1Y for Y enters the primary transfer nip for Y while the photoconductor 2Y rotates, due to the transfer electric field and the nip pressure, the Y toner image is primarily transferred onto the intermediate transfer belt 16 from the photoconductor 2Y. When the intermediate transfer belt 16 bearing the Y toner image passes through the primary transfer nips for M, C, and K with the endless movement thereof, the M, C, and K toner images on the photoconductors 2M, 2C, and 2K are primarily transferred and sequentially superimposed onto the Y toner image. A four-color toner image is formed on the intermediate transfer belt 16 by superimposition in this primary transfer process.

The secondary transfer roller 20 of the transfer unit 15 is disposed outside the loop of the intermediate transfer belt 16 and sandwiches the intermediate transfer belt 16 with the driven roller 18 inside the loop. Thus, the front surface of the intermediate transfer belt 16 contacts the secondary transfer roller 20 to form a secondary transfer nip. A secondary transfer voltage is applied to the secondary transfer roller 20 to form a secondary transfer electric field between the secondary transfer roller 20 and the driven roller 18 that is electrically grounded.

Below the transfer unit 15, a sheet tray 30 is slidably attached to and detachable from the printer body. The sheet tray 30 accommodates a plurality of recording media P as a transfer material in a state of a bundle of the recording sheets. In the sheet tray 30, the sheet feeding roller 30*a* contacts an uppermost recording sheet P of the bundle of recording sheets, and rotates counterclockwise in FIG. 1 at a predetermined timing to feed the recording sheet P to the sheet feeding path 31.

A registration roller pair 32 is disposed near an upper end of the sheet feeding path 31. As the recording sheet P strikes a contact portion of the stopped registration roller pair 32, a tilt of the recording sheet P is corrected. Subsequently, the registration roller pair 32 feeds the recording sheet P in synchronization with the four-color toner image on the intermediate transfer belt 16 in the secondary transfer nip.

The four-color toner image on the intermediate transfer belt 16 which is pressed against the recording sheet P at the secondary transfer nip is collectively transferred onto the recording sheet P due to the secondary transfer electric field and the nip pressure. Accordingly, a full-color toner image is formed on the recording medium P in combination with color of the recording sheet P. The recording sheet P carrying the full-color toner image is separated from the secondary transfer roller 20 and the intermediate transfer belt 16 due to the curvature of the driven roller 18 after the recording sheet P passes through the secondary transfer nip. After transfer, the recording sheet P is sent into a fixing device 34, which is described later, via a post-transfer conveyance path 33.

Transfer residual toner adhering to the intermediate transfer belt 16 after passing through the secondary transfer nip is removed from the surface of the intermediate transfer belt 16 by the belt cleaner 21 contacting the front surface of the intermediate transfer belt 16. The cleaning backup roller 22 disposed inside the loop of the intermediate transfer belt 16 supports the cleaning operation performed by the belt cleaner 21.

The fixing device 34 includes a fixing roller 34*a* and a pressure roller 34*b*. The fixing roller 34*a* contains a heat source such as a halogen lamp. The pressure roller 34*b* rotates while pressing against the fixing roller 34*a*, thereby forming a fixing nip therebetween. In the fixing device 34, the recording sheet P is nipped in the fixing nip such that a surface of the recording sheet P bearing an unfixed toner image tightly contacts the fixing roller 34*a*. Under heat and pressure, the toner in the toner image is softened and fixed onto the recording sheet P in the fixing nip.

The recording sheet P ejected from the fixing device 34 reaches a branch point of a sheet ejection path 36 and a pre-reversal conveyance path 41 via the post-fixing conveyance path 35. A switching pawl 42 is disposed on the side of the post-fixing conveyance path 35. The switching pawl 42 rotates around a rotation shaft 42a to close or open a vicinity of the end of the post-fixing conveyance path 35. The switching pawl 42 is stopped at the rotation position indicated by the solid line in FIG. 1, and the vicinity of the end of the post-fixing conveyance path 35 is opened at the timing when the recording sheet P is sent from the fixing device 34. Therefore, the recording sheet P enters the sheet ejection path 36 from the post-fixing conveyance path 35 and is sandwiched between a sheet ejection roller pair 37.

In the single-sided print mode, the recording sheet P pinched by the sheet ejection roller pair 37 is ejected to the outside of the printer body. Then, the recording sheet P is stacked on the stack portion which is the upper surface of the upper cover 50 of the printer body. On the other hand, in the duplex print mode, when a trailing end thereof passes through the post-fixing conveyance path 35 while a leading edge of the recording sheet P sandwiched by the sheet ejection roller pair 37 is conveyed in the sheet ejection path 36, the switching pawl 42 rotates to the position indicated by a broken line in FIG. 1, and the vicinity of the end of the post-fixing conveyance path 35 is closed. At substantially the same time, the sheet ejection roller pair 37 starts reverse rotation. Then, the recording sheet P is conveyed while turning the trailing end toward the top and enters into the pre-reversal conveyance path 41.

The right end portion of the printer 100 in FIG. 1 is a reversal unit 40 which can be hinged around a hinge shaft 40*a* to be opened and closed with respect to the printer body. As the sheet ejection roller pair 37 rotates in the reverse direction, the recording sheet P enters the pre-reversal conveyance path 41 of the reversal unit 40 and is conveyed downward in the vertical direction. Then, after passing through the reversal conveyance roller pair 43, the recording sheet P enters into the reversal conveyance path 44 which is curved in a semicircular shape. Further, as the recording sheet P is conveyed along the curved shape, the recording sheet P turns upward and flips a front surface and a back surface. Thereafter, the recording sheet P re-enters the secondary transfer nip via the above-described sheet feeding path 31. After the full-color image is collectively transferred to the other side of the recording sheet P, the recording sheet P sequentially passes through the post-transfer conveyance path 33, the fixing device 34, the post-fixing conveyance path 35, the sheet ejection path 36, and the sheet ejection roller pair 37 and is ejected outside the printer body.

Next, a method for adjusting the primary transfer voltage to be executed in the printer 100 according to one embodiment of the present disclosure is described.

The method makes use of the phenomenon that differences between discharge currents generated in the primary transfer nip at an image portion and at a blank portion affect subsequent primary transfers after the photoconductor 2 rotates one cycle, that is, an image density of a halftone image increases or decreases in an area where a solid image was formed and transferred after one cycle of the photoconductor 2 has been completed. In a case where the transfer voltage is low, the image density of the halftone image after one cycle of the photoconductor 2 from the solid image increases. In a case where the transfer voltage is high, the image density of the halftone image decreases. Therefore, it is possible to judge whether the transfer voltage is higher or lower than a preferable voltage. Adjustment of the primary transfer voltage in the printer 100 is individually performed for each of Y, M, C, and K colors, but the process is the same for each color and for simplicity an example of adjustment for only one color (that is, "K") is described below.

Figure 3:
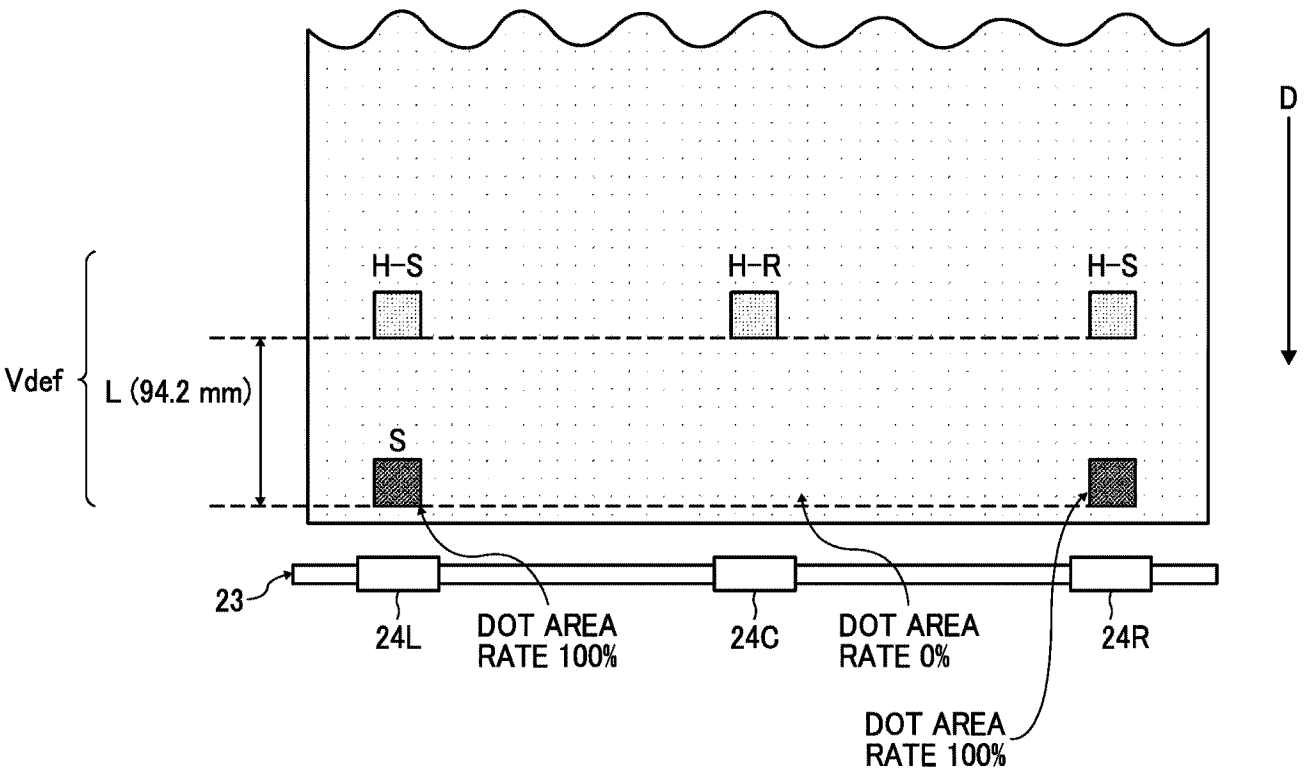
FIG. 3 is a schematic view illustrating a solid toner patch and a halftone toner patch transferred onto an intermediate transfer belt at the time of adjustment of a primary transfer voltage in the printer in FIG. 1.

FIG. 3 illustrates the relative positions of a solid toner patch S, a halftone toner patch H-R as a reference image, and a halftone toner patch H-S as a sample image formed on the intermediate transfer belt 16 at the time of adjustment of the primary transfer voltage. Note that, the "solid toner patch" here represents a toner image of a dark gray scale (dot area rate 100%) composed of a plurality of dots aligned without gaps (i.e. "high-density image"), and the "halftone toner patch" represents a dot image composed of a plurality of isolated dots aligned at intervals or a line image composed of a plurality of lines arranged at intervals from each other (i.e. "halftone image"). Alternatively, the halftone toner patch includes a solid image formed by reducing an exposure power, by which an amount of toner per unit area decreases.

In the printer 100, three specular reflection photosensors 24L, 24C, and 24R (also collectively "specular reflection photosensors 24",described later with reference to FIG. 4) serving as a detector to detect the image densities are disposed in the direction perpendicular to the rotational direction of the intermediate transfer belt 16 indicated by arrow D in FIG. 3. The position of an optical sensor unit 23 including the specular reflection photosensors 24 is illustrated in FIG. 1 as viewed from the front side of the printer 100. The solid toner patch S, the halftone toner patch H-S, and the halftone toner patch H-R are formed on the photoconductor 2K and primarily transferred to the intermediate transfer belt 16. The solid toner patches S and the halftone toner patches H-S are positioned at left side and right side of the intermediate transfer belt 16 corresponding to the specular reflection photosensors 24L and 24R facing the intermediate transfer belt 16. The halftone toner patch H-R are positioned at center of the intermediate transfer belt 16 corresponding to the specular reflection photosensor 24C facing the intermediate transfer belt.

First, at the positions corresponding to the specular reflection photosensors 24L and 24R, the solid toner patches S having a predetermined shape and area (that is, an image having a dot area rate of 100%) are formed on the photoconductor 2K and transferred onto the intermediate transfer belt 16 at a predetermined primary transfer voltage (hereinafter, referred to as "default primary transfer voltage"). Then, halftone toner patches H-S having a predetermined shape and area are formed one cycle downstream from tips of the solid toner patches S (a position where the photoconductor 2K having a diameter of 30 mm rotated by 94.2 mm) and primarily transferred onto the intermediate transfer belt 16 at the default primary transfer voltage.

On the other hand, a solid toner patch is not formed at the position corresponding to the specular reflection photosensor 24C, and only the halftone toner patch H-R having the same image structure as the halftone toner patch H-S is formed. Each of halftone toner patches H-S and H-R may be a line pattern horizontally reversed. That is, there is no toner image at the position one cycle downstream of the photoconductor 2 from the halftone toner patch H-R (i.e., a blank portion), and the dot area rate of the position is 0%. As a result, there are images with different dot area rates (amount of toner per unit area) at the positions one cycle downstream of the photoconductor 2 from the halftone toner patch H-S and the halftone toner patch H-R. The halftone toner patch H-R formed on the photoconductor 2K is also primarily transferred onto the intermediate transfer belt 16 at the default primary transfer voltage.

Then, when the halftone toner patches H-R and H-S pass by the optical sensor unit 23 as the intermediate transfer belt 16 rotates, the respective image densities (amount of toner adhering to the intermediate transfer belt 16 per unit area) are detected by the specular reflection photosensors 24 of the optical sensor unit 23. Accordingly, image density variations of the halftone toner patches H-R and H-S are obtained.

Figure 4:
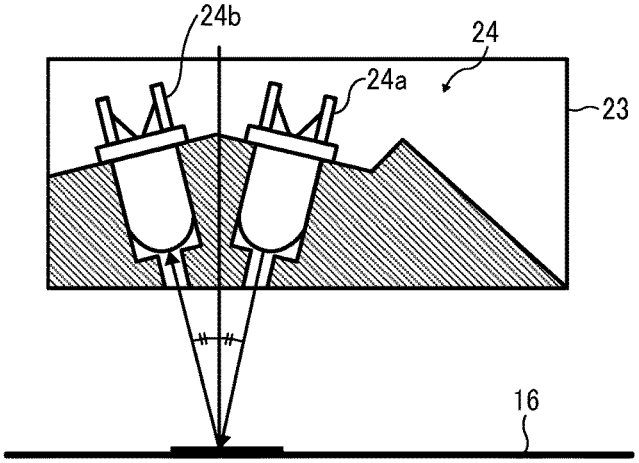
FIG. 4 is an enlarged schematic view illustrating a specular reflection photosensor of an optical sensor unit in the printer in FIG. 1.

FIG. 4 is an enlarged schematic view illustrating the specular reflection photosensor 24 of the optical sensor unit 23. The specular reflection photosensor 24 irradiates the front surface of the intermediate transfer belt 16 with light from an LED 24*a* as a light source. Then, the specular reflection type light receiving element 24*b* receives specular reflection light reflected on the front surface of the intermediate transfer belt 16 and outputs a voltage corresponding to an amount of light received. When the halftone toner patch passes the position facing the specular reflection photosensor 24 illustrated in FIG. 4, the light is specularly reflected in a region where dots are not formed in the entire region of the halftone toner patch, and the specular reflection type light receiving element 24*b* receives the reflected light. The amount of light received by the specular reflection type light receiving element 24*b* decreases as an area where the dots are formed increases, that is, as the amount of toner included in the halftone toner patch increases. Therefore, the image density of the halftone toner patch can be obtained based on the voltage output from the specular reflection type light receiving element 24*b*.

Here, a description is made of a case where the image density of the halftone toner patch H-S at the position where the solid toner patch S was formed as an immediately preceding transfer history is higher than the image density of the halftone toner patch H-R at the position where the toner patch was not formed as the immediately preceding transfer history, and the image density variations of the halftone toner patch H-S and the halftone toner patch H-R exceed an allowable value. In this case, the primary transfer voltage is adjusted so that the primary transfer voltage at the time of image formation becomes higher because the default primary transfer voltage is low (insufficient). Conversely, in a case where the image density of the halftone toner patch H-S is lower than the image density of the halftone toner patch H-R and the image density variations thereof exceed the allowable value, the primary transfer voltage at the time of image formation is lowered. Such a halftone toner patch has higher sensitivity to change in image density than a solid toner patch and is unlikely to cause a reduction of developing ability of a developing device (when a solid image is continuously formed, the amount of toner developed on the photoconductor may decrease). Therefore, the halftone toner patch is suitable for optimization and adjustment of transfer voltage.

Image density variations of the halftone toner patch H-S at the position where the solid toner patch was formed as the immediately preceding transfer history and the halftone toner patch H-R at the position where the toner patch is not formed as the immediately preceding transfer history (i.e., a blank area) are more likely to occur in an image forming apparatus having a weak charging capability, for example, an image forming apparatus using a roller charging method in which a DC voltage is applied from a DC power source. The potential difference between an image area and the blank area of the electrostatic latent image on the photoconductor 2 and a discharge history occurring between the image area and the blank area on the photoconductor 2 and the intermediate transfer belt 16 cause the image density variations. In other words, in order to utilize the discharge history generated in the primary transfer process, it is necessary to weaken the chargeability of the charging device 4 to a certain extent (that is, an amount of generated ions is minimized).

In addition, although the potential after transfer can be changed by the discharge at the time of transfer, if the post-transfer potentials are not different between the case where the image is formed and the case where there is no image as the immediately preceding transfer history, the transfer voltage is considered optimum. That is, transfer voltage conditions in which the potential of the image area (solid toner patch portion) and the potential of the blank area on the surface of the photoconductor 2 after passing through the transfer nip (that is, immediately before the charging device 4) are the same are optimum. In other words, transfer voltage conditions that generate such a strong transfer electric field that discharges occur between the blank area of the photoconductor 2 and the intermediate transfer belt 16 but the discharges do not occur between the image area of the photoconductor 2 and the intermediate transfer belt 16 are optimum. Accordingly, if the transfer voltage is adjusted so that the image density of the halftone toner patch H-R and that of the halftone toner patch H-S are the same, the transfer voltage condition can be optimized. A mechanism by which the post-transfer potential varies with the magnitude of the transfer voltage is described below.

Figure 5:
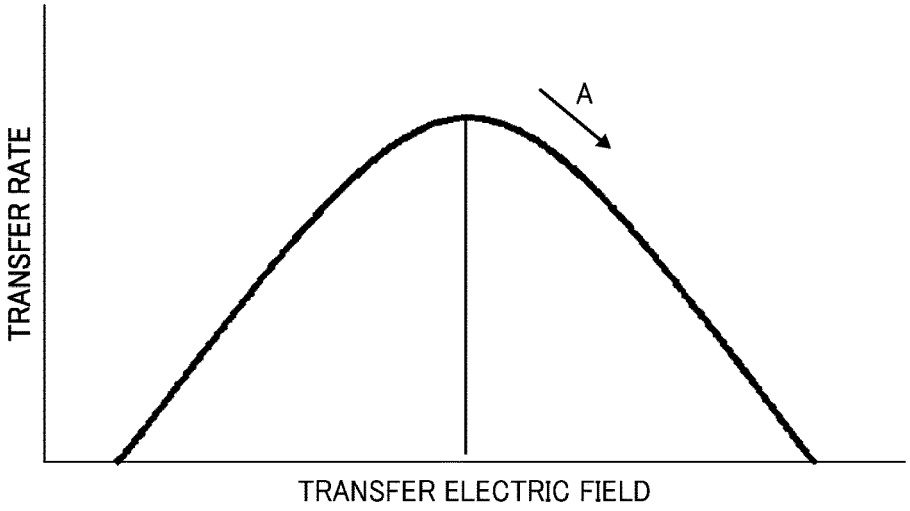
FIG. 5 is a graph illustrating a relation between a transfer electric field and a toner transfer rate.
Figure 6A:
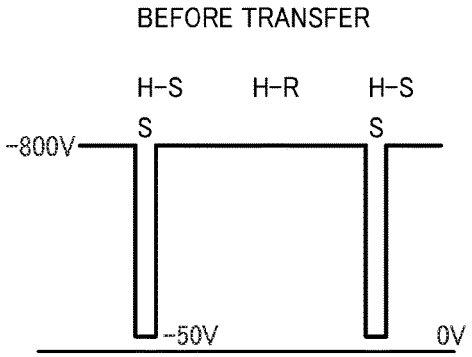
FIGS. 6A and 6B are conceptual diagrams illustrating a pre-transfer potential and a post-transfer potential when the transfer voltage is low.
Figure 6B:
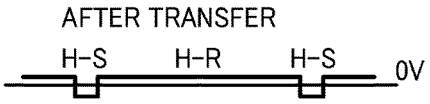

In general, it is known that a relation between the transfer electric field and the toner transfer rate has a peak as illustrated in FIG. 5. If the transfer electric field is too strong, charges are imparted to the toner by the discharge from the transfer electric field forming target (in the present embodiment, the intermediate transfer belt 16), the charging polarity of the toner is reversed, and reverse transfer occurs. As a result, the transfer rate decreases from the peak indicated by arrow A in FIG. 5. Therefore, the optimum transfer electric field is an electric field immediately before the discharge (impartation of electric charge) starts. When the transfer voltage is low, the post-transfer potential as illustrated in FIG. 6B is obtained because the potential distribution before transfer is as illustrated in FIG. 6A. If the plus charge moves from the intermediate transfer belt 16 to the photoconductor 2, the original potential distribution is maintained as is.

Figure 7A:
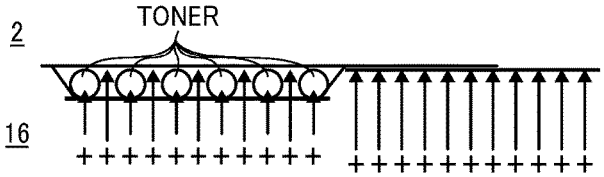
FIG. 7A is a conceptual diagram illustrating a state in which some voltage from a transfer is absorbed by toner when the transfer voltage is high.
Figure 7B:
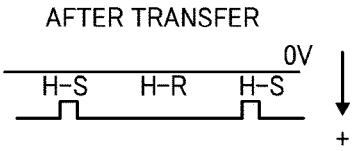
FIG. 7B is a conceptual diagram illustrating a post-transfer potential when the transfer voltage is high.

On the other hand, when the transfer voltage is high, as illustrated in FIG. 7A, the discharge (impartation of electric charges) starts, and in a place where toner is present, some of the electric charge from the intermediate transfer belt 16 is absorbed by toner. Accordingly, not all of the electric charge from the intermediate transfer belt 16 moves to the photoconductor 2. As a result, the potential after the transfer is an order of magnitude opposite to an order of magnitude when the transfer voltage is low, between places where the toner is present or not as illustrated in FIGS. 6B and 7B.

From the foregoing discussion, an optimum transfer voltage, that is, the voltage immediately before the discharge to the toner (impartation of electric charges) starts, is the transfer voltage immediately before the post-transfer potential is inverted. That is, the optimum transfer voltage is obtained when there are no image density variations.

Figure 8:
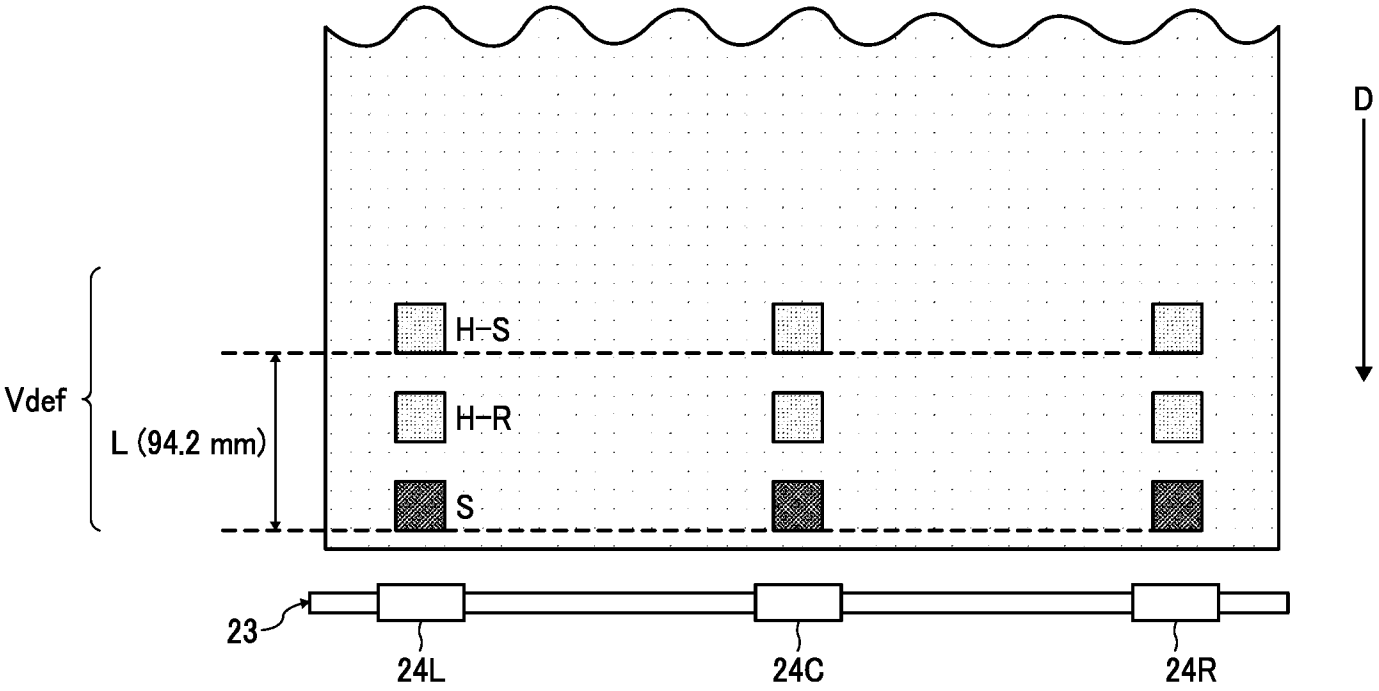
FIG. 8 is another schematic view illustrating a solid toner patch and a halftone toner patch transferred onto the intermediate transfer belt at the time of adjustment of the primary transfer voltage in the printer of FIG. 1.
Figure 9:
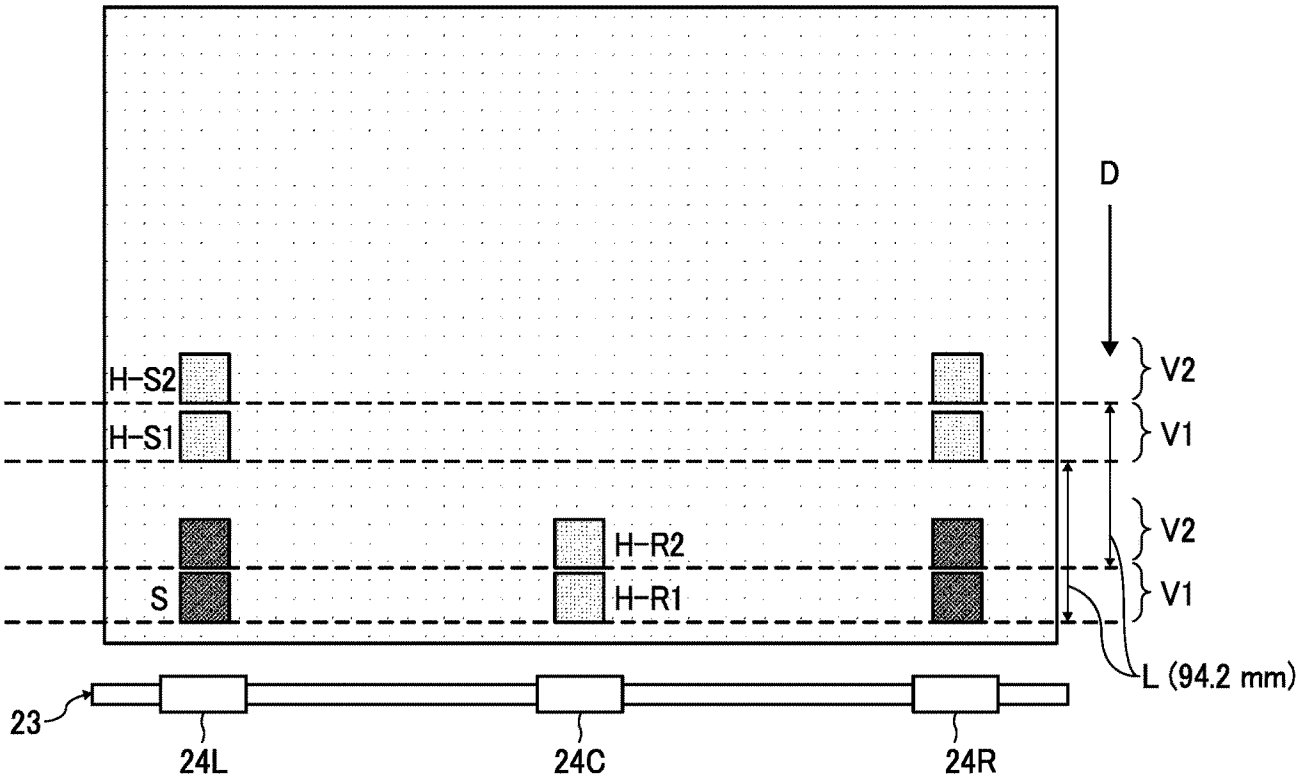
FIG. 9 is yet another schematic view illustrating a solid toner patch and a halftone toner patch transferred onto the intermediate transfer belt at the time of adjustment of the primary transfer voltage in the printer of FIG. 1.
Figure 10:
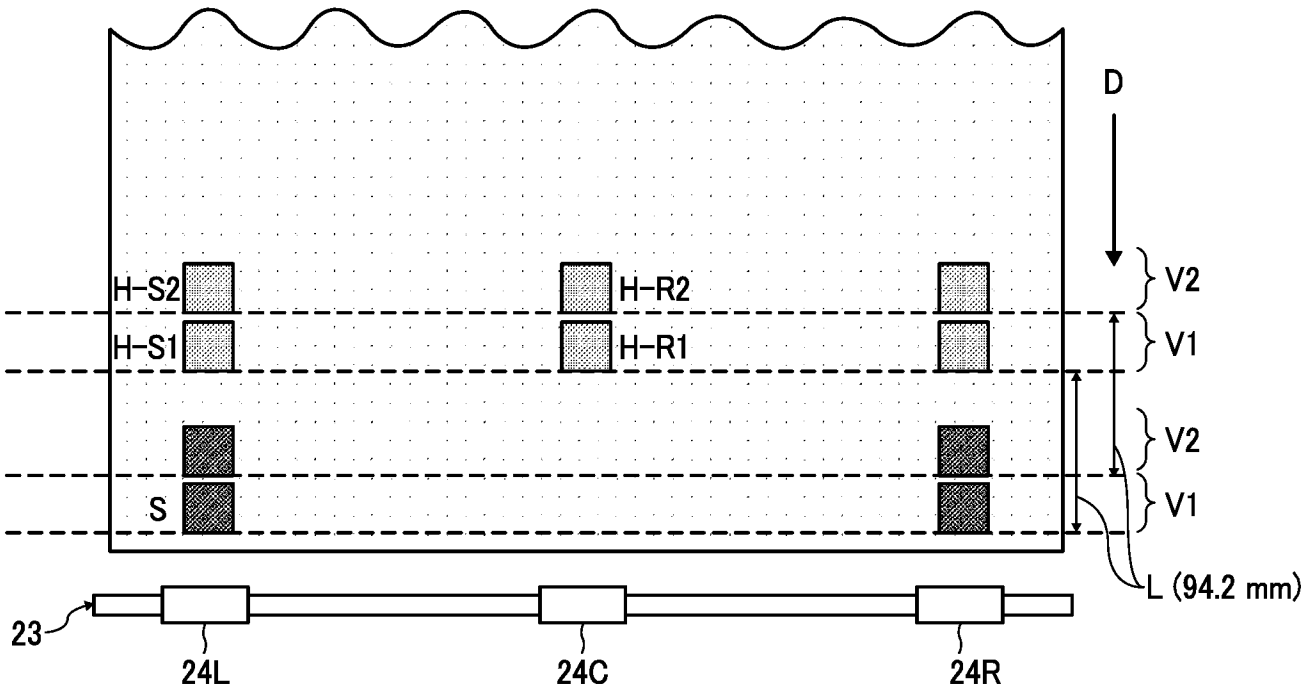
FIG. 10 is still yet another schematic view illustrating a solid toner patch and a halftone toner patch transferred onto the intermediate transfer belt at the time of adjustment of the primary transfer voltage in the printer of FIG. 1.

Incidentally, the solid toner patches S and the halftone toner patches H-R and H-S may be, for example, formed and primarily transferred in the relative positions illustrated in FIG. 8. Alternatively, as illustrated in FIGS. 9 and 10, a plurality of solid toner patches S can be formed and transferred using a plurality of transfer voltages, that is, while changing the primary transfer voltage (a primary transfer voltage V1 is not equal to a primary transfer voltage V2). The halftone toner patches H-R are formed and transferred at the same time as the plurality of solid toner patches S in FIG. 9. Subsequently, a plurality of halftone toner patches H-S can be formed and transferred in a similar manner at the position after one cycle of the photoconductor 2 from the plurality of solid toner patches S. The halftone toner patches H-R are formed and transferred at the same time as the plurality of halftone toner patches H-S in FIG. 10. Therefore, the transfer voltage at the time of image formation can be applied based on image density variations of the plurality of halftone toner patches H-S and H-R. That is, through these development and primary transfer, the primary transfer voltage at which the image density variations of the halftone toner patch H-R and the halftone toner patch H-S become substantially 0 is applied at the time of image formation. The primary transfer voltage at the time of image formation can be adjusted with higher accuracy by using a plurality of transfer voltages.

It is to be noted that, in order to adjust the primary transfer voltage, in the transfer unit 15 according to the present embodiment, data of the image density variations of the halftone toner images caused depending on whether there is a toner image with higher density as the immediately preceding transfer history than that of the halftone toner image and data of the magnitude of change of the primary transfer voltage that cancels the image density variations are specified by experiments and stored in a controller 60 of the printer body. The controller 60 determines the primary transfer voltage applied at a time of image formation, based on the data of the image density variations of the plurality of halftone images. Examples of the controller 60 include, but are not limited to, a central processing unit (CPU) and memory devices such as a random access memory (RAM) and a read only memory (ROM). The primary transfer voltage is adjusted based on the data.

Although the dot area rates (amount of toner per unit area) of the halftone toner patches H-R and H-S are not particularly limited, a dot area rate of 25% to 75% is preferable. As for the image formed one cycle downstream of the photoconductor 2 from the halftone toner patch H-S, the solid image (that is, the dot area rate 100%) is preferable because the discharge history of transfer most remarkably appears in the solid image. However, it is not necessary that the solid image be used. Alternatively, an image structure having the dot area rate higher than that of the halftone toner patch H-S, that is, an image patch having a large amount of toner per unit area (high-density patch) can be used. The image one cycle downstream of the photoconductor 2 from the halftone toner patch H-R is not necessarily the blank area (that is, the dot area rate 0%), but the dot area rate of the image is lower than or equal to that of the halftone toner patch H-R (the same dot area rate is also possible). It is to be noted that, the shape of the halftone toner patch H-S, H-R and the solid toner patch is not limited to the square, and other shapes (for example, a vertical band or the like) are acceptable.

As described above, since the present disclosure utilizes the discharge history generated in the primary transfer process, it is necessary to weaken the charging ability of the charging device 4 to some extent (minimize the amount of generated ions). From such a viewpoint, it is desirable for the charging device 4 to adopt a roller charging method in which the DC voltage is applied. In principle, the present disclosure is also applicable to an image forming apparatus employing an alternating current (AC) voltage charging device. In such a case, however, it is necessary to minimize generation of ions in the air by the AC electric field to some extent.

In general, an intermediate transfer belt or a transferor of an image forming apparatus is made of semiconductive material. An electrical resistance of an intermediate transfer belt or a transferor varies depending on manufacturing tolerances or environment in which the image forming apparatus is used. Variations in the electrical resistance may cause decrease in transfer rate or occurrence of afterimage. Although the electrical resistance of the transferor, the intermediate transfer belt, or the transfer material varies or amount of toner per unit area, amount of charge, film thickness of the image bearer, or contamination of the surface of the image bearer changes initially or with an elapse of time, the transferor applies the primary transfer voltage to form the transfer electric field at a time of image formation based on the image density variations of the plurality of halftone images according to the present disclosure, thereby transferring toner images appropriately.

As described above, the primary transfer voltage is appropriately adjusted, and stable toner imaging can be obtained over a long period of time. Particularly in an image forming apparatus of one-component development, a toner deterioration is severe, and a slight deviation from the optimum transfer voltage may lead to a large image quality deterioration. Therefore, adjustment of the primary transfer voltage according to the present disclosure is effective for the image forming apparatus of one-component development. Alternatively, although the present disclosure has been described as an intermediate transfer type image forming apparatus, the present disclosure can be adopted to direct transfer type image forming apparatuses.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. An image forming apparatus comprising:

a latent image bearer to bear a plurality of halftone images having a same image density and a high-density image having a larger amount of toner per unit area than the plurality of halftone images;

a transferor to apply a predetermined primary transfer voltage to form a transfer electric field between the latent image bearer and the transferor to transfer the plurality of halftone images and the high-density image;

a transfer electric field target to bear the plurality of halftone images and the high-density image transferred from the latent image bearer by the transfer electric field, and the transfer electric field target is to bear the high-density image at a position one cycle of the latent image bearer downstream from at least one of the plurality of halftone images in a direction of rotation of the transfer electric field target;

a detector to detect image densities of the plurality of halftone images on the transfer electric field target; and a controller to determine a primary transfer voltage applied at a time of image formation, based on image density variations between the at least one of the plurality of halftone images that is one cycle downstream in the rotation direction of the latent image bearer from the high-density image and at least one other of the plurality of halftone images, the image density variations being detected by the detector.

2. The image forming apparatus according to claim 1, wherein the controller sets a voltage at which the image density variations of the plurality of halftone images detected by the detector become 0, to the primary transfer voltage applied at the time of image formation.

3. The image forming apparatus according to claim 1, wherein the transferor applies a plurality of transfer voltages to form and transfer the plurality of halftone images and the high-density image, wherein the controller determines the primary transfer voltage applied at the time of image formation, based on the image density variations of the plurality of halftone images transferred by the plurality of transfer voltages.

4. The image forming apparatus according to claim 1, wherein the high-density image is a solid image.

5. The image forming apparatus according to claim 1, further comprising:

a charging roller to charge the latent image bearer; and a DC power source to apply a DC voltage to the charging roller.

6. The image forming apparatus according to claim 1, wherein the at least one other of the plurality of halftone images includes one or more halftone image for which no high-density image is located one cycle of the latent image bearer downstream from the one or more halftone image.

* * * * *